US008092200B2

(12) United States Patent
IiJima et al.

(10) Patent No.: US 8,092,200 B2
(45) Date of Patent: Jan. 10, 2012

(54) GAS COMPRESSOR WITH A PRESSURE BYPASS VALVE BEING FORMED IN A COMPRESSED GAS PASSAGE OR AN OIL SEPARATION SPACE

(75) Inventors: Hiroshi IiJima, Saitama (JP); Hiromiki Ohno, Saitama (JP)

(73) Assignee: Calsonic Kansei Corporation, Saitama (JP)

( * ) Notice: Subject to any disclaimer, the term of this patent is extended or adjusted under 35 U.S.C. 154(b) by 416 days.

(21) Appl. No.: 12/382,792

(22) Filed: Mar. 24, 2009

(65) Prior Publication Data

US 2009/0246061 A1 Oct. 1, 2009

(30) Foreign Application Priority Data

Mar. 25, 2008 (JP) ..... 2008-077590
Aug. 20, 2008 (JP) ..... 2008-211910

(51) Int. Cl.
*F04C 27/02* (2006.01)
*F04C 29/02* (2006.01)

(52) U.S. Cl. ..... 418/97; 418/96; 418/270; 418/DIG. 1; 55/312; 55/309.1

(58) Field of Classification Search ..... 418/259, 418/270, DIG. 1, 93, 96–98; 55/459.1, 467, 55/312, 309.1; 96/400
See application file for complete search history.

(56) References Cited

U.S. PATENT DOCUMENTS 4,963,074 A * 10/1990 Sanuki et al. ..... 417/222.1
5,411,385 A * 5/1995 Eto et al. ..... 418/96
5,499,515 A 3/1996 Kawamura et al.
5,733,107 A * 3/1998 Ikeda et al. ..... 418/DIG. 1
6,511,530 B2 * 1/2003 Iwanami et al. ..... 418/DIG. 1
6,599,101 B2 * 7/2003 Matsuura et al. ..... 418/DIG. 1
2005/0226756 A1 10/2005 Ito

FOREIGN PATENT DOCUMENTS

GB 2012874 A * 8/1979
JP 2007-327340 12/2007

OTHER PUBLICATIONS

European Office Action issued Nov. 3, 2010 in corresponding European Patent Application No. 09 00 4090.

* cited by examiner

*Primary Examiner* — Theresa Trieu
(74) *Attorney, Agent, or Firm* — Wenderoth, Lind & Ponack, L.L.P.

(57) ABSTRACT

In a gas compressor, a cyclone block is configured to include a substantially cylindrical space into which a compressed gas is introduced to separate refrigeration oil from the gas. A pressure bypass is formed in the substantially cylindrical space defined by an outer cylindrical unit and an inner cylindrical unit to communicate with a discharge chamber having lower pressure than that of the substantially cylindrical space. The pressure bypass includes a pressure valve to open and close the pressure bypass in accordance with the internal pressure of the substantially cylindrical space having the pressure bypass. During a high speed operation of a compressor unit, the coolant gas including unseparated refrigeration oil is discharged from the pressure bypass.

11 Claims, 8 Drawing Sheets

B

C

GAS COMPRESSOR WITH A PRESSURE BYPASS VALVE BEING FORMED IN A COMPRESSED GAS PASSAGE OR AN OIL SEPARATION SPACE

CROSS REFERENCE TO RELATED APPLICATION

The present application is based on and claims priority from Japanese Patent Application No. 2008-077590, filed on Mar. 25, 2008, No. 2008-211910, filed on Aug. 20, 2008, the disclosure of which is hereby incorporated by reference in its entirety.

BACKGROUND OF THE INVENTION

1. Field of the Invention

The present invention relates to a gas compressor, and specifically to an improvement of an oil separator which centrifuges oil from a compressed gas discharged from a compressor.

2. Description of the Related Art

An air conditioning system has used a gas compressor for compressing a gas such as a coolant gas and thus circulating the compressed gas in the air conditioning system.

A compressor generally includes a compressor unit compressing and discharging a gas; and an oil separator separating oil such as refrigeration oil from the compressed coolant gas discharged from this compressor unit.

A known oil separator includes an outer cylindrical unit including a substantially columnar space with a closed bottom end surface by an end wall having an oil discharging passage; and an inner cylinder portion in a substantially cylindrical form provided inside the outer cylindrical unit and being almost coaxial with the substantially columnar space of the outer cylindrical unit. This type of oil separator centrifuges refrigeration oil from the compressed coolant gas by allowing rotating compressed coolant gas to flow through a substantially cylindrical space (an oil separating space) defined by the inner surface of the outer cylindrical unit and the outer surface of the inner cylinder portion (See Japanese Unexamined Patent Application Publication No. 2007-327340).

The inner cylinder portion and the outer cylindrical unit are separate parts. The inner cylinder portion is fixed to the outer cylindrical unit by press-fitting or caulking. Thereby, the inner cylinder portion and the outer cylindrical unit are integrated to be the oil separator.

The compressor changes the rotation speed in accordance with a desired output from the air conditioning system. During a high speed rotation, the coolant gas flows at a very high speed through the oil separating space of the oil separator, so that the compressor unit exhibits a better oil separation performance that in the normal operation.

With the improvement in oil separation performance, an amount of the refrigeration oil (or oil content rate (OCR)) to be discharged together with the coolant gas from the gas compressor to the air conditioning system is decreased. The less the amount of refrigeration oil discharged to the air conditioning system (condenser), the less the amount of refrigeration oil returned together with the coolant gas to the gas compressor from the air conditioning system (evaporator). This decreases the amount of refrigeration oil mixed in the coolant gas to be suctioned into compression chambers, which accordingly reduces the amount of refrigeration oil to be introduced into the compression chambers together with the coolant gas. Accordingly, with a reduction in the amount of refrigeration oil as the coolant, the temperature of the coolant gas discharged from the compression chambers is increased, resulting in decreasing the volumetric efficiency.

In order to prevent this problem, during high speed rotation of the compressor, prevention of excessive decrease in the OCR is required.

SUMMARY OF THE INVENTION

An object of the present invention is to provide a gas compressor which can prevent excessive decrease in the oil content rate during a high speed rotation.

According to one aspect of the invention, a gas compressor comprises a compressor unit compressing a supplied gas into a high-pressure compressed gas; an oil separator separating oil from the compressed gas which is discharged from the compressor unit; and a compressed gas passage through which the compressed gas flows from the compressor unit to the oil separator, in which the oil separator includes an oil separation space into which the compressed gas is introduced to separate the oil therefrom, a pressure bypass is formed in either of the compressed gas passage and the oil separation space to communicate with a space having a lower pressure than an internal pressure of the oil separation space; and the pressure bypass comprises a pressure valve to open and close the pressure bypass.

In one features of the above aspect, the pressure valve opens and closes the pressure bypass in accordance with an internal pressure of either of the compressed gas passage and the oil separation space.

In the other features of the above aspect, the pressure valve is set to open the pressure bypass when the internal pressure is equal to or more than a predetermined pressure and close the pressure bypass when the internal pressure is lower than the predetermined pressure.

In the other features of the above aspect, the pressure valve is provided in the oil separation space of the oil separator.

In the other feature of the above aspect, the oil separator includes an outer cylindrical unit including a substantially columnar space with one end closed; and an inner cylinder portion in a substantially cylindrical form provided in an axis direction of the substantially columnar space; and a substantially cylindrical space defined by an inner surface of the outer cylindrical unit and an outer surface of the inner cylinder portion is the oil separation space.

In the other features of the above aspect, the oil separator includes an outer cylindrical unit including a substantially columnar space with one end closed, and a seating surface in the other end of the substantially columnar space; an inner cylindrical unit including an inner cylinder portion in a substantially cylindrical form with a diameter smaller than a diameter of the substantially columnar space, and a flange portion continuing into an end portion of the inner cylinder portion to be able to come in contact with the seating surface; and a spring biasing the inner cylindrical unit to the outer cylindrical unit in an axis direction of the substantially columnar space of the outer cylindrical unit while the inner cylinder portion of the inner cylindrical unit is placed inside the substantially columnar space, so that the flange portion of the inner cylindrical unit comes in contact with the seating surface of the outer cylindrical unit. A substantially cylindrical space defined by an inner surface of the outer cylindrical unit and an outer surface of the inner cylinder portion of the inner cylindrical unit is the oil separation space. Further, the spring is set to separate the flange portion of the inner cylindrical unit from the seating surface by the internal pressure of the oil separation space when the internal pressure of the oil separation space is equal to or more than a predetermined pressure, so that the seating surface, the flange portion and the spring function as the pressure valve and a gap between the seating surface and the flange portion functions as the pressure bypass.

In the other features of the above aspect, the pressure valve opens and closes the pressure bypass in accordance with an amount of vertical load acting on a cross section of the pressure bypass due to the compressed gas flowing through the pressure bypass.

In the other features of the above aspect, the pressure bypass is formed to extend straight on an extension line of the compressed gas passage.

In the other features of the above aspect, the oil separator includes an outer cylindrical unit including a substantially columnar space with one end closed, and an inner cylinder portion in a substantially cylindrical form in an axis direction of the substantially columnar space; a substantially cylindrical space defined by an inner surface of the outer cylindrical unit and an outer surface of the inner cylinder portion is the oil separation space; and the compressed gas passage and the pressure bypass face each other with the substantially cylindrical space being interposed in between, and are formed on a straight line.

In the other features of the above aspect, the pressure valve opens and closes the pressure bypass according to a flow volume and a flow velocity of the compressed gas flowing through the pressure bypass, or to a cross-sectional area of the pressure bypass and the flow velocity.

In the other features of the above aspect, the pressure valve is set to open the pressure bypass when the amount of vertical load is equal to or larger than a predetermined amount and close the pressure bypass when the amount of vertical load is smaller than the predetermined amount.

BRIEF DESCRIPTIONS OF THE DRAWINGS

DESCRIPTION OF THE PREFERRED EMBODIMENT

Hereinafter, embodiments of a gas compressor according to the present invention will be described in detail with reference to the accompanying drawings.

Figure 1:
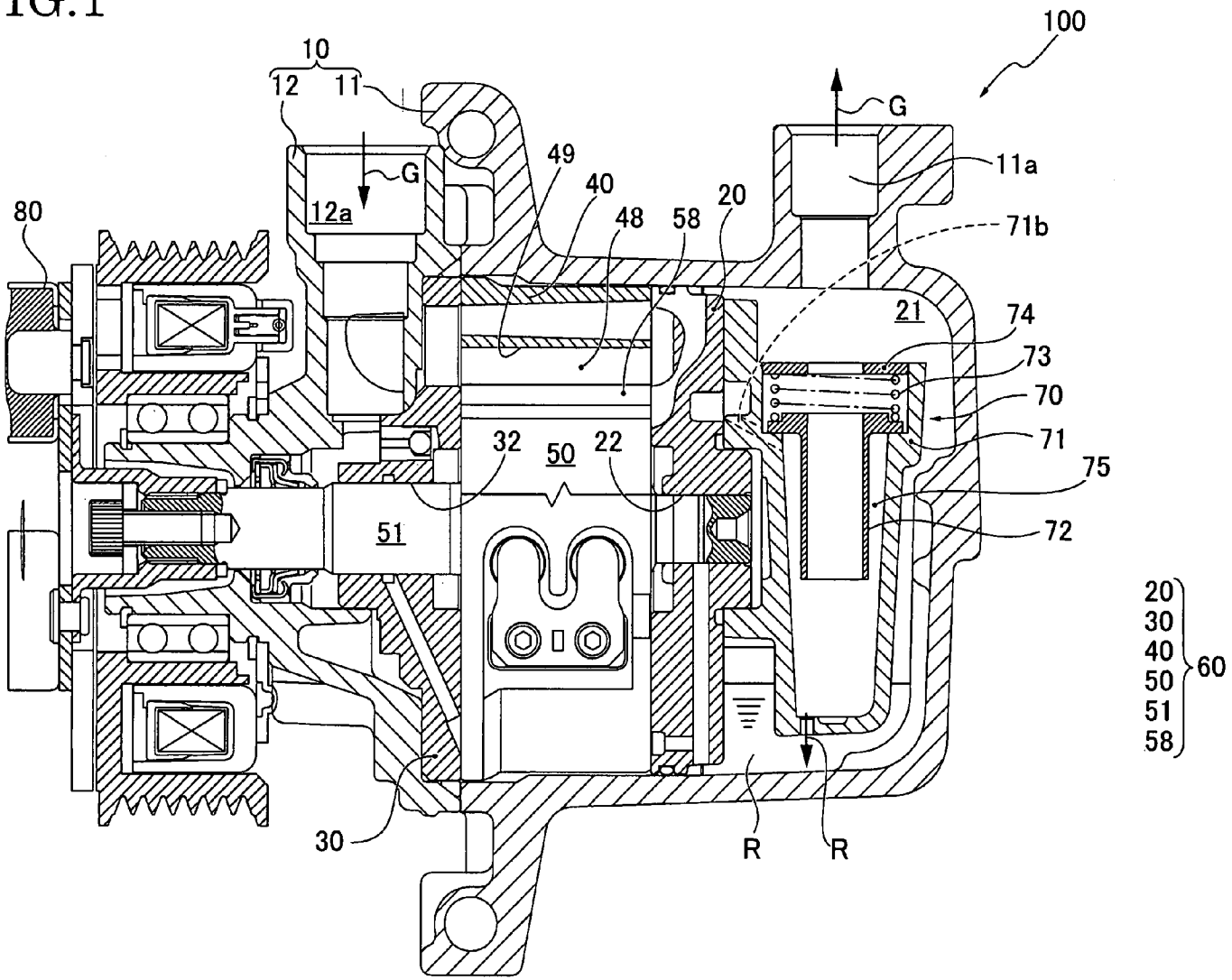
FIG. 1 is a vertical cross-sectional view of a rotary vane compressor as an example of a gas compressor according to the present invention.
Figure 2:
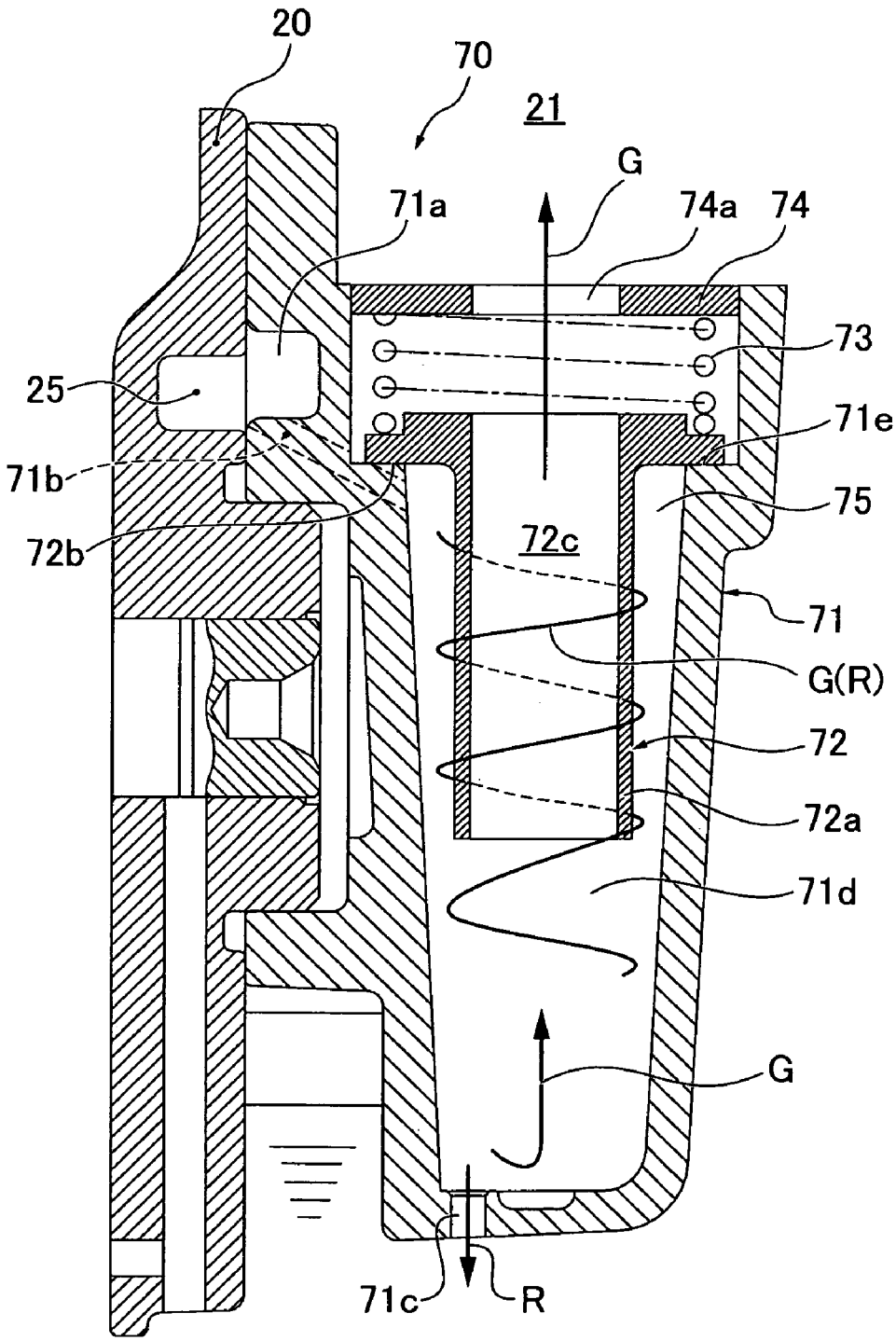
FIG. 2 is a magnified view showing details of a cyclone block in FIG. 1 during normal operation or stop of operation except for high-speed operation and liquid compression (while a pressure valve is closed).

FIG. 1 is a vertical cross-sectional view showing a rotary vane compressor 100 (hereinafter referred to as a compressor 100) as the embodiment of the present invention. FIG. 2 is a magnified view showing details of a cyclone block 70 shown in FIG. 1.

The compressor 100 in FIG. 1 is configured, for instance, to be a part of an air conditioning system which cools down air using heat of vaporization of a coolant. The compressor 100 is provided in a coolant circulation passage, together with the other components of this air conditioning system such as a condenser, an expansion valve and an evaporator (not shown).

The compressor 100 compresses a coolant gas G (a gas, a compressed gas) as a gaseous coolant supplied from the evaporator of the air conditioning system, and supplies this compressed coolant gas G to the condenser. Through heat exchange among the compressed coolant gas G, ambient air and the like, the condenser releases heat from the coolant gas G, and thus liquefies the coolant gas G. Subsequently, the condenser transmits the high-pressure liquid coolant to the expansion valve.

The high-pressure liquid coolant is then low-pressurized by the expansion valve and transmitted to the evaporator. The evaporator evaporates the low-pressure liquid coolant through absorbing heat from its ambient air. Through this heat exchange, the coolant cools down the air around the evaporator.

The low-pressure coolant gas G thus evaporated is returned to the compressor 100 and compressed. Thereafter, the above-described processes are repeated.

The compressor 100 contains a compressor unit 60 and a cyclone block 70 inside a housing 10. The cyclone block 70 is a centrifugal type oil separator.

The housing 10 includes a case 11 and a front head 12. The case 11 is shaped in a cylinder form and has one end closed and the other end opened. The front head 12 covers the open end of the case 11. When the front head 12 is assembled with the case 11, a space containing the compressor unit 60 and the cyclone block 70 (or the oil separator) are formed inside the housing 10.

The front head 12 includes an inlet port 12*a* through which the low-pressure coolant gas G is supplied from the evaporator. The case 11 includes a discharge port 11*a* through which the high-pressure coolant gas G compressed by the compressor unit 60 is discharged to the condenser.

The compressor unit 60 includes a rotary shaft 51 rotationally driven on its axis; a columnar rotor 50 integrally rotating with the rotary shaft 51; a cylinder 40 having an inner circumferential surface 49 in an almost elliptic cross-sectional contour which surrounds the outside of an outer circumferential surface of the rotor 50 and has two open ends in the axis direction of the rotary shaft 51; five plate-shaped vanes 58 embedded in the rotor 50 at intervals of equal angles around the rotary shaft 51, protrudable outward from the outer circumference of the rotor 50 with a variable amount to follow the contour shape of the inner circumferential surface 49 of the cylinder 40; and a front side block 30 and a rear side block 20 fixed to cover surfaces of the two open ends of the cylinder 40, respectively.

The compressor unit 60 includes compression chambers 48 each defined by the two side blocks 20, 30, the cylinder 40, the rotor 50, and two adjacent vanes 58, 58 in a rotation direction of the rotary shaft 51. The compressor unit 60 is configured to compress the coolant gas G suctioned into each compression chamber 48 through the front side block 30 and discharge the compressed coolant gas G through the rear side block 20 by repeatedly increasing and decreasing the volume of each compression chamber 48 in accordance with the rotation of the rotary shaft 51.

One of the two portions of the rotary shaft 51 protruding from the two ends of the rotor 50 is pivotally supported by a bearing 32 of the front side block 30, and extends to the outside of the front head 12 through the front head 12 so as to be connected to a driving force transmitter 80 to which a not-shown outside driving force is transmitted.

The other of the two protruding portions of the rotary shaft 51 is pivotally supported by a bearing 22 of the rear side block 20.

The coolant gas G is discharged from the compressor unit 60 to a discharge chamber 21 defined by the case 11, the compressor unit 60 and the cyclone block 70 through the cyclone block 70. The above-described discharge port 11*a* communicates with the discharge chamber 21.

Refrigeration oil R separated from the coolant gas G by the cyclone block 70 is accumulated in the bottom of the discharge chamber 21. The refrigeration oil R is used for back pressure to allow the vanes 58 to protrude (press the vanes 58 against the inner circumferential surface 49 of the cylinder 40) or a lubricant for the compression chambers 48 and the like, and is supplied to the inside of the compressor unit 60 via oil guiding passages formed in the rear side block 20 and the like.

First Embodiment

The cyclone block 70 is assembled with the rear side block 20 of the compressor unit 60, and separates the refrigeration oil R (oil) from the high-pressure coolant gas G which is discharged from each compression chamber 48 through the rear side block 20.

As shown in detail in FIG. 2, the cyclone block 70 includes an outer cylindrical unit 71 having a substantially columnar space 71*d* with one lower end closed and a seating surface 71*e* at the other end which is not closed; an inner cylindrical unit 72 including an inner cylinder portion 72*a* in a substantially cylindrical form and having a diameter which is smaller than that of the substantially columnar space 71*d* of the cylinder portion 71 and a flange portion 72*b* continuing into an upper end portion of the inner cylinder portion 72*a* and being able to come in contact with the seating surface 71*e* of the outer cylindrical unit 71; a helical spring 73 which biases the inner cylindrical unit 72 to the outer cylindrical unit 71 in an axis direction of the substantially columnar space 71*d* of the outer cylindrical unit 71 while the inner cylinder portion 72*a* of the inner cylindrical unit 72 is placed inside the substantially columnar space 71*d*, so that the flange portion 72*b* of the inner cylindrical unit 72 can come in contact with the seating surface 71*e* of the outer cylindrical unit 71; and a holding member 74 which holds one end of the helical spring 73 (not in contact with the flange portion 72*b*) so as not to displace the helical spring 73.

In this respect, the outer cylindrical unit 71 includes a discharge hole 71*c* in the lower end through which the refrigeration oil R separated from the coolant gas G by this cyclone block 70 is discharged to the bottom of the discharge chamber 21.

The holding member 74 is fixed to an upper end portion of the outer cylindrical unit 71 by caulking or screwing, and has a gas discharge hole 74*a* in a center portion through which the coolant gas G flows to the discharge chamber 21.

The helical spring 73 biases the inner cylindrical unit 72 to the outer cylindrical unit 71 in order to keep the flange portion 72*b* of the inner cylindrical unit 72 in contact with the seating surface 71*e* of the outer cylindrical unit 71, and is held between the holding member 74 and the inner cylindrical unit 72.

As shown in FIG. 2, the high-pressure coolant gas G is discharged from each compression chamber 48 to a substantially cylindrical space 75 through the compressed gas passage made of a first passage 25 in the rear side block 20, and a second passage 71*a* and a third passage 71*b* in the main outer cylindrical unit 71. The substantially cylindrical space 75 is defined by the inner surface of the outer cylindrical unit 71 of the cyclone block 70 and the outer surface of the inner cylinder portion 72*a* of the inner cylindrical unit 72.

Subsequently, the discharged high-pressure coolant gas G descends turning helically in the substantially cylindrical space 75 due to an air flow generated by the discharge of the high-pressure coolant gas G. Refrigeration oil R in the high-pressure coolant gas G is separated therefrom with centrifugal force of the helically turning high-pressure coolant gas G. The thus-separated refrigeration oil R flows down to a bottom portion of the substantially columnar space 71*d* in the outer cylindrical unit 71, and drops down into the discharge chamber 21 through the discharge hole 71*c*.

Meanwhile, the coolant gas G centrifuged from the refrigeration oil R hits the bottom portion of the substantially columnar space 71*d* in the outer cylindrical unit 71 and ascends, and flows through the inner space 72*c* in the inner cylinder portion 72*a* of the inner cylindrical unit 72 and the gas discharge hole 74*a* in the holding member 74. Then, the coolant gas G is discharged to the discharge chamber 21.

As described above, the substantially cylindrical space 75 defined by the inner surface of the outer cylindrical unit 71 and the outer surface of the inner cylinder portion 72*a* of the inner cylindrical unit 72 functions as an oil separation space through which the refrigeration oil R is separated from the coolant gas G.

Generally, the helical spring 73 biases the flange portion 72*b* of the inner cylindrical unit 72 by its elastic force so that the flange portion 72*b* of the inner cylindrical unit 72 comes in contact with the seating surface 71*e* of the outer cylindrical unit 71. However, the helical spring 73 is set to have the elastic modulus and the amount of initial contraction to be elastically deformed to contract when the compressor 100 is in high speed rotation or liquid compression or when the internal pressure of the substantially cylindrical space 75 becomes equal to or higher than a predetermined pressure.

Figure 3:
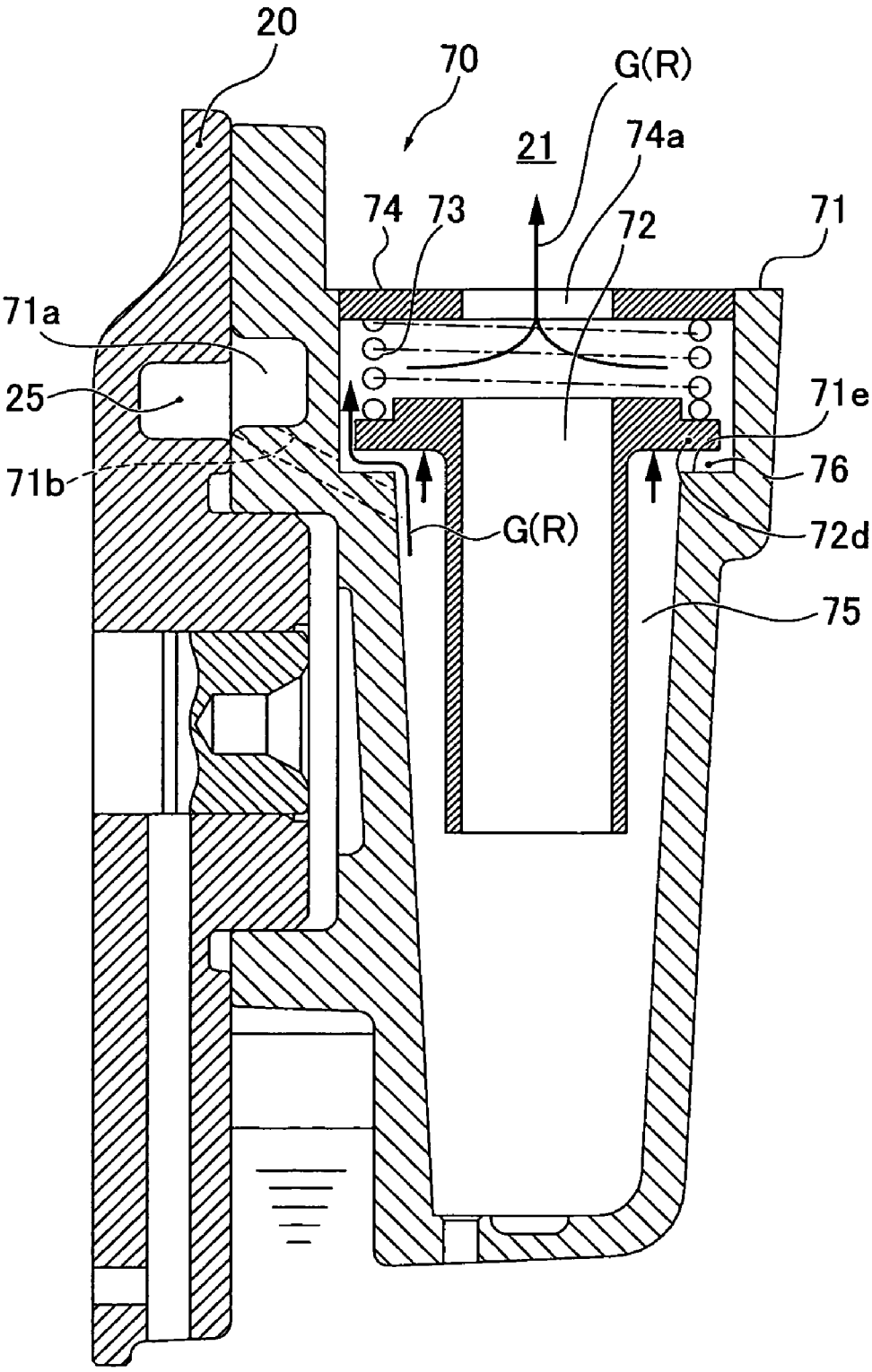
FIG. 3 is another magnified view showing details of the cyclone block in FIG. 1 during high-speed operation and liquid compression (while the pressure valve is opened).

In other words, with the internal pressure of the substantially cylindrical space 75 being equal to or higher than the predetermined pressure, as shown in FIG. 3, the internal pressure acting on the inner cylindrical unit 72 from below exceeds the biasing force of the helical spring 73. Consequently, the helical spring 73 is elastically deformed to contract. Thereby, the inner cylindrical unit 72 is displaced upward, and the flange portion 72*b* of the inner cylindrical unit 72 is separated from the seating surface 71*e* of the outer cylindrical unit 71 to create a gap between the flange portion 72*b* and the seating surface 71*e*.

The gap between the flange portion 72*b* and the seating surface 71*e* constitutes a pressure bypass 76 communicating with the discharge chamber 21 with a pressure lower than the internal pressure of the substantially cylindrical space 75. The high-pressure coolant gas G discharged to the substantially cylindrical space 75 is discharged to the discharge chamber, 21 flowing through the pressure bypass 76 and through the gas discharge hole 74*a* of the holding member 74.

In this case, descending not turning helically inside the substantially cylindrical space 75, the high-pressure coolant gas G is not centrifuged enough to separate the refrigeration oil R. Because of this, the coolant gas G discharged to the discharge chamber 21 includes a larger amount of refrigeration oil R than the coolant gas G discharged during the normal operation of the compressor 100 (other than the high-speed operation).

Consequently, a larger amount of refrigeration oil R is transferred through the discharge port 11*a* to the air conditioning system (condenser) located outside of the compressor 100 than that transferred while the compressor 100 is in the normal operation. Thereby, a low OCR (oil content rate) during high speed operation of the compressor 100 is preventable.

Specifically, with the compressor 100 according to the present embodiment configured the same as the conventional compressor, it is possible to increase the flow rate of the coolant gas G in the substantially cylindrical space 75 of the cyclone block 70 during the high speed rotation than during the normal operation and improve oil separation performance of the substantially cylindrical space 75 by centrifugation.

The improved oil separation performance leads to decreasing the amount of refrigeration oil R discharged with the coolant gas G from the compressor 100 to the air conditioning system (condenser) (or decreases the OCR). The decrease in the amount of the refrigeration oil R flowing to the air conditioning system (condenser) leads to decreasing the amount of the refrigeration oil R in the coolant gas G returning to the compressor 100 from the air conditioning system (condenser).

In accordance with the decrease, the coolant gas G including a reduced amount of refrigeration oil R is suctioned into each compression chamber 48, and introduced into each compression chamber 48 together with the coolant gas G. This decrease in the refrigeration oil R as the coolant raises the temperature of the coolant gas G discharged from each compression chamber 48, and consequently decreases the volumetric efficiency.

The compressor 100 according to the present embodiment, however, is configured that the seating surface 71*e* of the outer cylindrical unit 71, the flange portion 72*b* of the inner cylindrical unit 72, and the helical spring 73 (including the holding member 74) constitute the pressure valve for opening and closing the pressure bypass 76 which is formed according to the internal pressure of the substantially cylindrical space 75 (or the oil separation space). In response to an increased internal pressure of the substantially cylindrical space 75 by the high-speed operation of the compressor 100, the pressure valve opens the pressure bypass 76. Thereby, the substantially cylindrical space 75 and the compressed gas passage including the first passage 25, the second passage 71*a* and the third passage 71*b* communicate with the discharge chamber 21 having the lower pressure. Accordingly, the coolant gas G is flowed into the discharge chamber 21 through the pressure bypass 76 before the refrigeration oil R is fully separated from the coolant gas G in the substantially cylindrical space 75.

Consequently, the coolant gas G flowing into the discharge chamber 21 includes a larger amount of refrigeration oil R than the compressed coolant gas G which is centrifuged to separate the refrigeration oil R in the substantially cylindrical space 75 in the conventional manner. The compressed coolant gas G including a larger amount of refrigeration oil R than that obtained in the conventional manner is discharged to the outside of the compressor 100 (or to the air conditioning system) through the discharge chamber 21. This increases the OCR, and accordingly prevents the OCR from decreasing excessively while the compressor 100 is operating at high speed.

In addition, in the cyclone block 70 of the compressor 100 according to the present embodiment the inner cylindrical unit 72 need not be firmly fixed to the outer cylindrical unit 71 by press-fitting and caulking the inner cylindrical unit 72 into the outer cylindrical unit 71 for example, unlike the oil separator of the conventional compressor. In the conventional cyclone block 70 in which the inner cylindrical unit 72 is firmly fixed to the outer cylindrical unit 71, for example, if the internal pressure of the substantially cylindrical space 75 becomes extraordinarily higher than expected due to liquid compression in any one of the compression chambers 48, an unexpected damage may occur to break the fixation of the inner cylindrical unit 72 and the outer cylindrical unit 71. In contrast, in the compressor 100 according to the present embodiment, such a problem will never occur because the inner cylindrical unit 72 is not fixed to the outer cylindrical unit 71 in the first place. Furthermore, the pressure bypass 76 is opened before the internal pressure of the substantially cylindrical space 75 becomes extraordinarily high or the predetermined pressure which is lower than the extraordinarily high pressure. This can prevent the internal pressure of the substantially cylindrical space 75 from becoming continuously higher than the predetermined pressure for a long time, and accordingly prevent unexpected damage to the cyclone block 70.

Consequently, it is possible to set the strength necessary for the members (the outer cylindrical unit 71 and the inner cylindrical unit 72) forming the substantially cylindrical space 75 in the cyclone block 70 to be lower than that in the conventional gas compressor.

When rotational speed of the compressor unit is changed from high to low, or when the liquid compression is resolved, the internal pressure of the substantially cylindrical space 75 is decreased below the predetermined pressure. Thereby, the internal pressure acting on the flange portion 72 from therebelow becomes smaller than the biasing force of the helical spring 73. The helical spring 73 biases the inner cylindrical unit 72 towards the outer cylindrical unit 71 by its resilience (elastic force) from a larger contraction than the initial contraction so that the flange portion 72*b* comes in contact with the seating 71*e* (or expands to the amount of initial contraction of the helical spring 73). This accordingly closes the pressure bypass 76 as the gap between the flange portion 72*b* and the seating surface 71*e*.

Consequently, the cyclone block 70 returns to be in the original state shown in FIG. 2 (or to its normal operation or its stopping state). Thereby, as described above, the coolant gas G discharged to the substantially cylindrical space 75 descends turning helically inside the substantially cylindrical space 75. Thus, the coolant gas G is centrifuged to separate the refrigeration oil R from the coolant gas G. The refrigeration oil R thus separated drops down through the discharge hole 71*c* to the discharge chamber 21. The coolant gas G is discharged to the discharge chamber 21 through the inner space 72*c* of the inner cylindrical unit 72 and the gas discharge hole 74*a* of the holding member 74.

The foregoing compressor 100 according to the present embodiment is exemplary of a configuration in which the outer cylindrical unit 71, the inner cylindrical unit 72 and the spring 73 function as the pressure valve for opening and closing the pressure bypass 76, the outer cylindrical unit 71 and the inner cylindrical unit 72 forming the substantially cylindrical space 75 serving as the oil separation space of the cyclone block 70. However, the gas compressor according to the present invention is not limited to the compressor 100 comprising such a pressure valve.

Second Embodiment

Figure 4A:
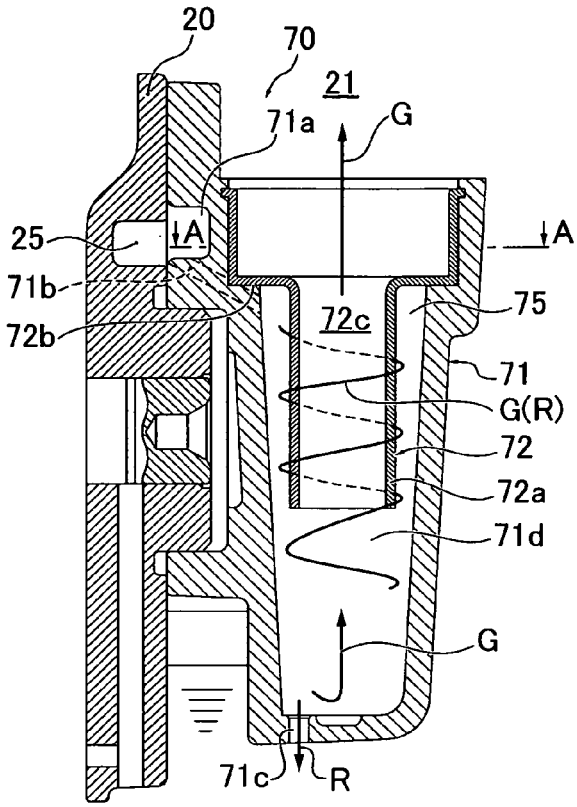
FIG. 4A is a magnified view showing details of a cyclone block in a rotary vane compressor according to a second embodiment of the present invention.
Figure 4B:
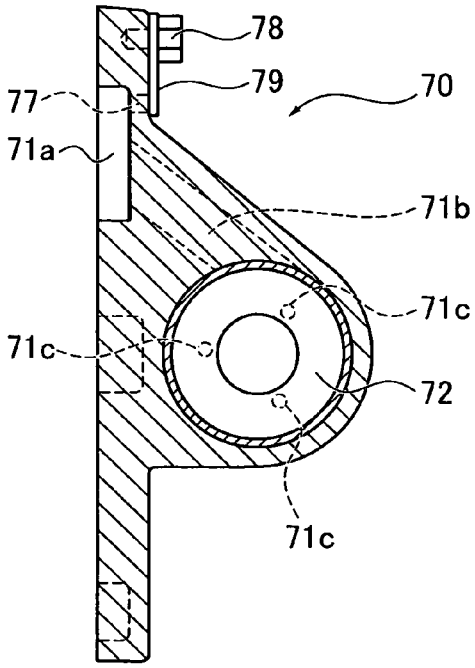
FIG. 4B is a cross-sectional view of the cyclone block taken along the A-A line of FIG. 4A while a pressure valve is closed.

Another example of a gas compressor will be described. FIG. 4A correspond to FIGS. 2 and 3, and FIGS. 4B and 4C are cross-sectional views of a cyclone block taken along the A-A line of FIG. 4A. In FIGS. 4A, 4B, the cyclone block 70 is configured to include the outer cylindrical unit 71 which has a pressure bypass 77 through which the second passage 71*a* of the outer cylindrical unit 71 communicates with the discharge chamber 21, and a leaf spring valve 79 (a pressure valve) fixed to the outer cylindrical unit 71 by use of a fastening member 78, for opening and closing the pressure bypass 77 in accordance with the internal pressure of the compressed gas passage.

While the internal pressure of the compressed gas passage is lower than a predetermined pressure as shown in FIG. 4B, the leaf spring valve 79 is not deformed to maintain the closed pressure bypass 77 and guide the coolant gas G discharged from each compression chamber 48 to the cyclone block 70.

Figure 4C:
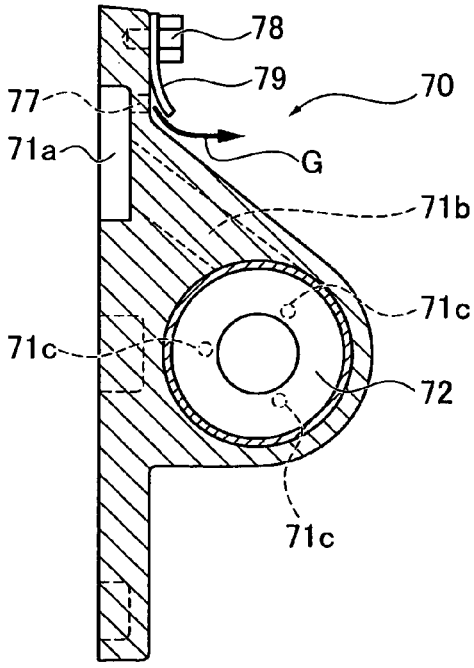
FIG. 4C is a cross-sectional view of the cyclone block taken along the A-A line of FIG. 4A while the pressure valve is opened.

On the other hand, when the internal pressure of the compressed gas passage is higher than the predetermined pressure as shown in FIG. 4C, the leaf spring valve 79 receives the pressure from the pressure bypass 77, and is elastically deformed toward the discharge chamber 21 to open the pressure bypass 77. Consequently, the coolant gas G discharged from each compression chamber 48 is directly discharged to the discharge chamber 21 through this pressure bypass 77.

For this reason, the coolant gas G having flowed into the discharge chamber 21 through the pressure bypass 77 includes a larger amount of refrigeration oil R than the compressed coolant gas G which is centrifuged to fully separate the refrigeration oil R in the substantially cylindrical space 75 in the conventional manner. The compressed coolant gas G including the a larger amount of refrigeration oil R than that obtained in the conventional manner is discharged to the outside of the compressor 100 (or to the air conditioning system) through the discharge chamber 21. This increases the OCR, and accordingly can prevent the OCR from decreasing excessively while the compressor unit is operating at high speed.

In the oil separator in which the outer cylindrical unit 71 and the inner cylindrical unit 72 simultaneously constitute the pressure valve (that is, the oil separator in which only the outer cylindrical unit 71 or the inner cylindrical unit 72 constitutes the pressure valve, the cyclone block 70 according to the above-described embodiment), the outer cylindrical unit 71 and the inner cylindrical unit 72 need not be separately formed unlike the compressor 100 according to the above-described embodiment.

In other words, the oil separator has only to include a cylinder portion (a part corresponding to the outer cylindrical unit 71 according to the above embodiment) including a substantially columnar space with one end closed; and an inner cylinder portion in substantially cylindrical from (a part corresponding to the inner cylinder portion 72*a* of the inner cylindrical unit 72 according to the above embodiment) provided in an axis direction of this substantially columnar space. The oil separator is configured that the cylinder portion and the inner cylinder portion is integrally formed; a substantially cylindrical space defined by an inner surface of the cylinder portion and an outer surface of the inner cylinder portion serves as an oil separation space (a part corresponding to the substantially cylindrical space 75 according to the present embodiment); a pressure bypass communicating with the discharge chamber 21 in the cylinder portion or the inner cylinder portion; and a pressure valve for opening and closing the pressure bypass in the cylinder portion or the inner cylinder portion in which the pressure bypass is formed.

In addition, the compressor 100 according to the present embodiment is a gas compressor including the pressure bypass 76 and the pressure valve in the cyclone block 70. However, the gas compressor according to the present invention is not limited thereto. The gas compressor according to the present invention may alternatively include the pressure bypass 76 and the pressure valve in the compressed gas passage (including the first passage 25 formed in the rear side block 20 as well as the second passage 71*a* and the third passage 71*b* which are formed in the outer cylindrical unit 71) through which the compressed coolant gas G flows from the compression chambers 48 in the compressor unit 60 to the cyclone block 70.

Third Embodiment

Figure 5:
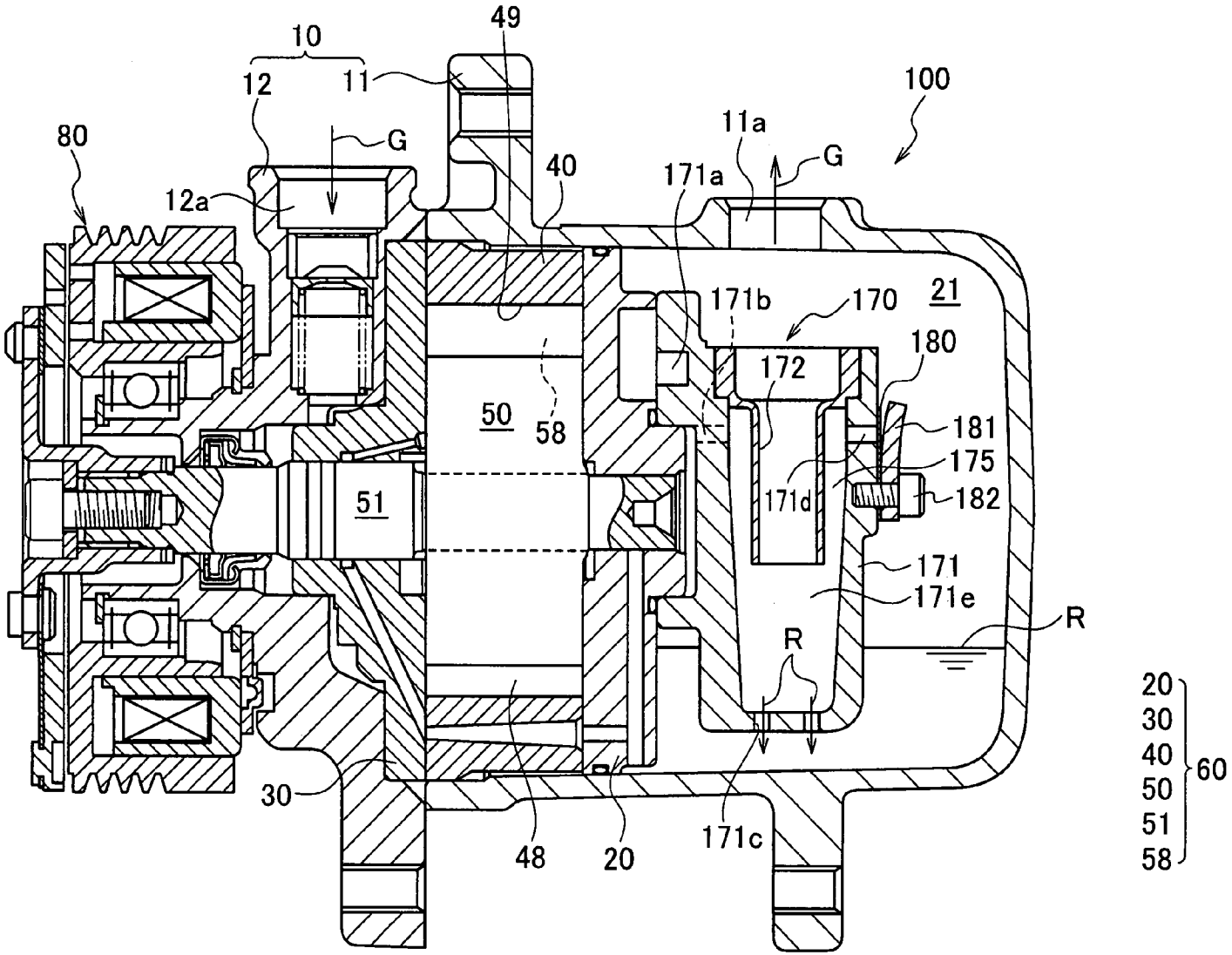
FIG. 5 is a vertical cross-sectional view of a rotary vane compressor according to a third embodiment of the present invention.

FIG. 5 is a vertical cross-sectional view showing a rotary vane compressor 100 as a gas compressor according to another embodiment of the present invention. FIGS. 6A, 6B, 7A and 7B are magnified views showing a cyclone block 70 shown in FIG. 5.

The rotary vane compressor 100 according to the present embodiment has the same compressor unit as the rotary vane compressor 100 according to the foregoing embodiments. The present embodiment has the same configuration as the above-described embodiment except a cyclone block. Accordingly, a description will be made only on the cyclone block.

The cyclone block 170 is assembled with the rear side block 20 of the compressor unit 60, and separates the refrigeration oil R (oil) from the high-pressure coolant gas G discharged from each compression chamber 48 through the rear side block 20. As shown in FIG. 6 in detail, the cyclone block 170 includes an outer cylindrical unit 171 including a substantially columnar space 171*e* with one end closed; and an inner cylindrical unit 172 in a substantially cylindrical form provided in an axis direction of the substantially columnar space 171*e* of this outer cylindrical unit 171.

Discharge holes 171*c* are formed in the lower end of the outer cylindrical unit 171. Through the discharge holes 171*c*, the refrigeration oil R separated from the coolant gas G by this cyclone block 170 is discharged to the bottom portion of the discharge chamber 21.

Figure 6A:
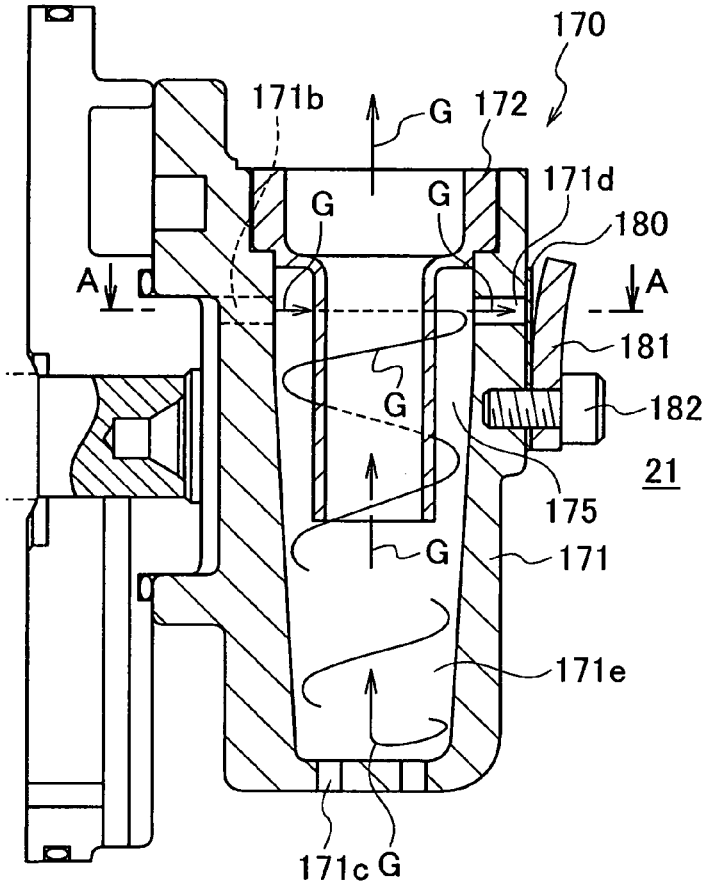
FIG. 6A is a magnified view showing details of the cyclone block in FIG. 5 during normal operation or stop of operation except for high-speed operation and liquid compression (while a pressure valve closed).

As shown in FIG. 6A, the high-pressure coolant gas G discharged from each compression chamber 48 flows through a compressed gas passage 171*b*, and is subsequently discharged into a substantially cylindrical space 175 in the cyclone block 170. The substantially cylindrical space 175 is defined by an inner surface of the outer cylindrical unit 171 and an outer surface of the inner cylindrical unit 172.

Thereafter, the high-pressure coolant gas G is discharged into the substantially cylindrical space 175 and descends turning helically due to an air flow from the discharged high-pressure coolant gas G, which causes the refrigeration oil R to be separated from the high-pressure coolant gas G with centrifugal force of the gas G. The refrigeration oil R thus separated flows down into a bottom portion of the substantially columnar space 171*e* in the outer cylindrical unit 171, and subsequently drops down into-the discharge chamber 21 through the discharge holes 171*c*.

On the other hand, the coolant gas G after the separation of the refrigeration oil R hits the bottom portion of the substantially columnar space 171*e* in the outer cylindrical unit 171, ascends from the center portion of the substantially cylindrical space 175, and is discharged to the discharge chamber 21 through the inner space in the inner cylindrical unit 172. Thereafter, flowing through the discharge port 11*a* of the case 11, the coolant gas G is discharged to the condenser.

In this manner, the substantially cylindrical space 175 defined by the inner surface of the outer cylindrical unit 171 and the outer surface of the inner cylindrical unit 172 functions as a space (oil separation space) for allowing the refrigeration oil R to be separated from the coolant gas G.

Furthermore, a pressure bypass 171*d* is formed in the circumferential wall of the outer cylindrical unit 171. The pressure bypass 171*d* causes the substantially cylindrical space 175 to communicate with the discharge chamber 21 having its pressure lower than the internal pressure of the substantially cylindrical space 175. A pressure valve 180 is provided in order to close an opening of the pressure bypass 171*d*. The opening thereof is located on the outer circumferential surface of the outer cylindrical unit 171.

This pressure valve 180 is an elastic member such as a leaf spring, which is fixed to the circumferential wall of the outer cylindrical unit 171 by use of a bolt 182. The pressure valve 180 is elastically deformed to open the opening of the pressure bypass 171*d*, which is closed by the pressure valve 180. The pressure valve 180 opens and closes the pressure bypass 171*d* in accordance with the amount of vertical load F acting on the cross-section of the pressure bypass 171*d* due to the compressed coolant gas G flowing through the pressure bypass 171*d*.

Moreover, a not elastically deformable valve support 181 and the pressure valve 180 are fixed to the outer cylindrical unit 171 by use of the bolt 182. When an amount of elastic deformation of the pressure valve 180 reaches a predetermined amount, the elastically-deformed pressure valve 180 collides with the valve support 181. The valve support 181 prevents the pressure valve 180 from being elastically deformed excessively, and accordingly prevents a closing function of the pressure bypass 171*d* from being impaired by the pressure valve 180, which would otherwise occur when the pressure valve 180 is elastically deformed excessively.

Note that the compressed gas passage 171*b* which allows the high-pressure compressed coolant gas G discharged from the compressor unit 60 to flow therethrough opens to an upper portion of the substantially cylindrical space 175, and that the pressure bypass 171*d* is formed so as to extend straight on the extension line of the compressed gas passage 171*b* with the substantially cylindrical space 175 being interposed between the pressure bypass 171*d* and the compressed gas passage 171*b*. Consequently, part of the compressed coolant gas G ejected from the compressed gas passage 171*b* to the substantially cylindrical space 175 serving as the oil separation space directly flows through the pressure bypass 171*d* on the extension line of the compressed gas passage 171*b* due to inertia which acts on the compressed coolant gas G when flowing through the compressed gas passage 171*b*.

The compressed coolant gas G having flowed through this pressure bypass 171*d* almost keeps the force which acts thereon while flowing through the compressed gas passage 171*b*. Accordingly, the load F acting on the cross section of the pressure bypass 171*d* precisely reflects the load which acts on the cross section of the compressed gas passage 171*b* while the compressed gas is flowing therethrough.

As the force of the compressed coolant gas G flowing through the compressed gas passage 171*b* (the load acting on the cross-section of the compressed gas passage 171*b*) increases because the compressor unit 60 rotates at higher speed, the load F acting on the cross-section of the pressure bypass 171*d* correspondingly increases with a high precision. Consequently, it is possible to make the opening/closing operation of the pressure valve 180 which opens and closes the pressure bypass 171*d* precisely correspond to the rotational speed of the compressor unit 60.

In addition, the compressed gas passage 171*b* and the pressure bypass 171*d* are formed in a straight line to face each other with the substantially cylindrical space 175 being interposed in between.

In this respect, the load F[N] acting on the cross-section of the pressure bypass 171*d* is expressed by $$F=\rho Qv$$

where $\rho$[kg/m$^3$], Q[m$^3$/s] and v[m/s] denote the density, the flow volume and the flow velocity of the coolant gas G, respectively. In a high speed rotation of the compressor unit 60, as the flow velocity v and the flow volume Q of the coolant gas G increase, the load F increases.

In addition, the flow volume Q is expressed by $$Q=Sv$$

where S[m$^2$] denotes the vertical cross-sectional area of the cross-section of the pressure bypass 171*d*. Because $F=\rho Qv^2$, the load F increases as the flow velocity v of the coolant gas G increases.

Figure 6B:
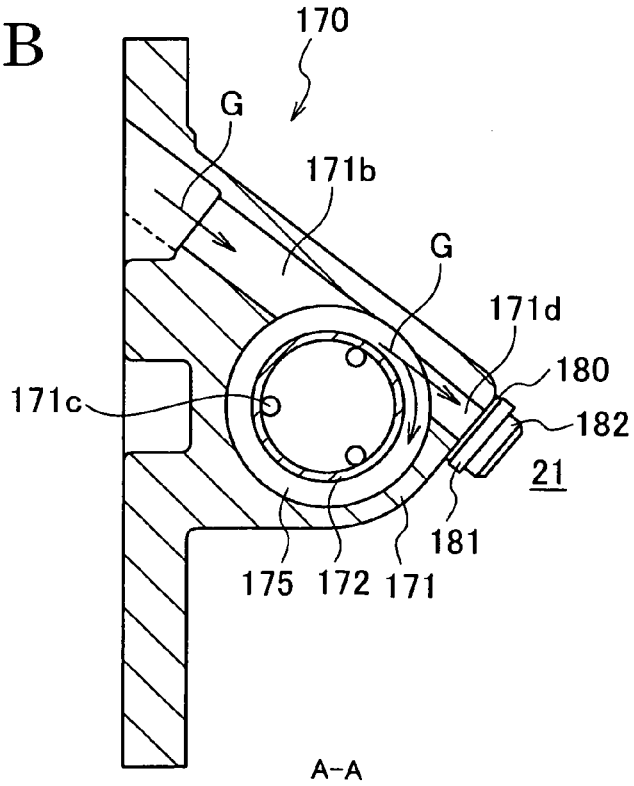
FIG. 6B is a cross-sectional view of the cyclone block taken along the A-A line of FIG. 6A while the pressure valve is closed.
Figure 7A:
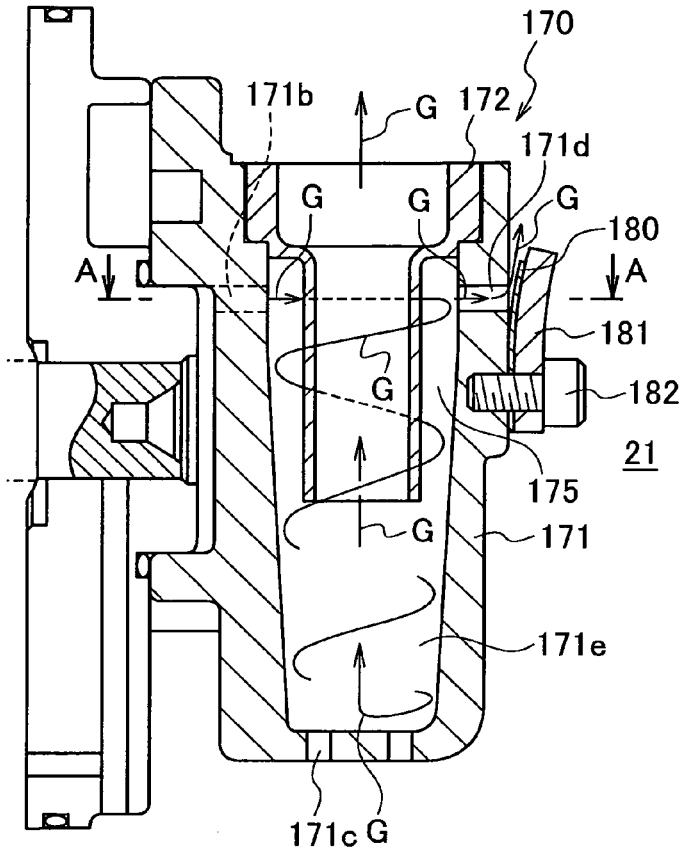
FIG. 7A is another magnified view showing details of the cyclone block in FIG. 5 during high-speed operation and liquid compression (while the pressure valve is opened).
Figure 7B:
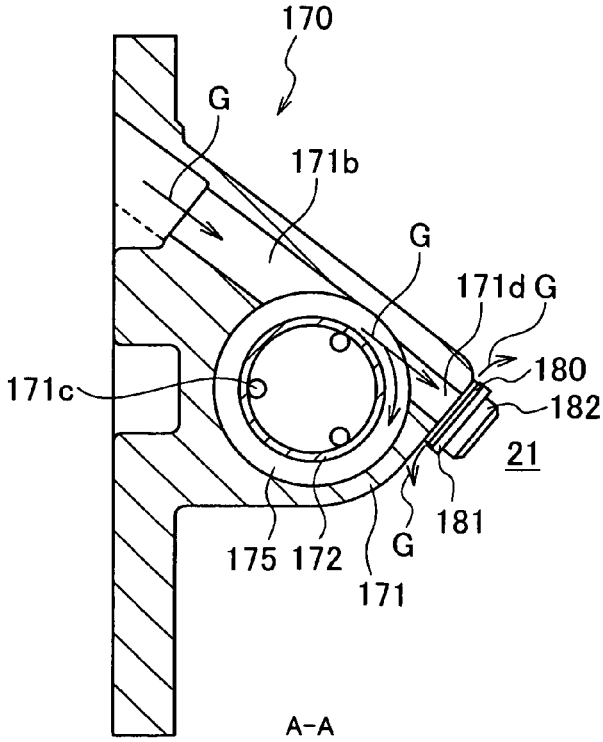
FIG. 7B is a cross-sectional view of the cyclone block taken along the A-A line of FIG. 7A while the pressure valve is opened.

In the compressor 100 according to the present embodiment as shown in FIG. 6A and FIG. 6B (showing the cross-section of the cyclone block taken along the A-A line of FIG. 6A) as well as FIG. 7A and FIG. 7B (showing the cross-section of the cyclone block taken along the A-A line of FIG. 7A), the coolant gas G is discharged from the compressor unit 60, subsequently flows through the compressed gas passage 171*b*, and thereafter is ejected to the substantially cylindrical space 175 in the cyclone block 170. The part of the ejected coolant gas G directly flows into the pressure bypass 171*d*.

In this respect, while the rotational speed of the compressor unit 60 is within a range of a low to medium speed (or is lower than a predetermined rotational speed), the load F acting on the cross-section of the pressure bypass 171*d* is smaller than a predetermined value. Consequently, as shown in FIGS. 6A and 6B, the pressure valve 180 is not elastically deformed, and keeps covering the exit-side opening of the pressure bypass 171*d*. Thereby, the coolant gas G ejected to the substantially cylindrical space 175 does not flow into the discharge chamber 21 through the pressure bypass 171*d*.

For this reason, the coolant gas G ejected to the substantially cylindrical space 175 descends turning helically inside the substantially cylindrical space 175, while keeping a force from the ejection to the substantially cylindrical space 175 from the compressed gas passage 171*b*.

While the coolant gas G descends turning helically therein, the refrigeration oil R in the coolant gas G is separated from the coolant gas G by centrifugal force which acts on the coolant gas G.

Consequently, a degree of separation of the refrigeration oil R from the coolant gas G by centrifugal force is determined in accordance with the force of the coolant gas G when ejected from the compressed gas passage 171*b* to the substantially cylindrical space 175.

On the other hand, while the rotational speed of the compressor unit 60 is within a high speed range (or equal to or higher than the predetermined rotational speed), the load F acting on the cross-section of the pressure bypass 171*d* is larger than the predetermined value. Consequently, as shown in FIGS. 7A and 7B, the pressure valve 180 is elastically deformed to open the exit-side opening of the pressure bypass 171*d*. Thereby, part of the coolant gas G ejected to the substantially cylindrical space 175 flows from the pressure bypass 171*d* into the discharge chamber 21.

Accordingly, ejected into the substantially cylindrical space 175, the coolant gas G loses the force from the ejection from the pressure bypass 171*b*. Accordingly, the coolant gas G descends turning helically in the substantially cylindrical space 175.

While the coolant gas G descends turning helically therein, the refrigeration oil R in the coolant gas G is separated from the coolant gas G with centrifugal force which acts on the coolant gas G.

Consequently, the degree of separation of the refrigeration oil R from the coolant gas G by centrifugal force is determined in accordance with a force lower than the force of the coolant gas G ejected from the compressed gas passage 171*b* to the substantially cylindrical space 175. That is, it is lower than the degree of separation determined by the force of the coolant gas G from the ejection from the compressed gas passage 171*b* to the substantially cylindrical space 175.

Consequently, the refrigeration oil R is prevented from being excessively separated from the coolant gas G while the rotational speed of the compressor unit 60 is within the high speed range. In this case, the coolant gas G including the refrigeration oil R remaining through the oil separation in the substantially cylindrical space 175 hits the bottom portion of the substantially columnar space 171*e*, ascends in the center portion of the substantially cylindrical space 175, and is discharged to the discharge chamber 21 through an inner space in the inner cylindrical unit 172. Finally, the coolant gas G is discharged to the condenser flowing through the discharge port 11*a* in the case 11.

Accordingly, the amount of refrigeration oil R transferred through the discharge port 11*a* to the air conditioning system (or the condenser) located outside of the compressor 100 is smaller than the amount of refrigeration oil R which is transferred to the conventional compressor while the rotational speed of the conventional compressor is within a high speed range. This prevents the problem of the prior art that the oil content rate (OCR) decreases while the conventional compressor is operating at high speed.

Furthermore, because the pressure bypass 171*d* extends straight, the compressor 100 according to the present embodiment can decrease attenuation of the load F occurring from the inlet to the outlet of the pressure bypass 171*d* to a minimum, unlike a compressor having a meander pressure bypass 171*d*.

Consequently, the compressor 100 according to the present embodiment can make the opening/closing operation of the pressure valve 180 placed in the outlet of the pressure bypass 171*d* precisely correspond to the load F acting on the inlet of the pressure bypass 171*d*. Accordingly, the compressor 100 according to the present embodiment prevents decrease in the precision with which the pressure valve 180 carries out its opening/closing operation in accordance with the load of the coolant gas G which is discharged from the compressed gas passage 171*b*.

Moreover, the compressor 100 according to the present embodiment can guide, to the pressure bypass 171*d*, a part of the coolant gas G ejected from the compressed gas passage 171*b* to the substantially cylindrical space 175 with the force of the coolant gas G from the ejection from the compressed gas passage 171*b* maintained. This is because the compressed gas passage 171*b* and the pressure bypass 171*d* are opposed to each other in a straight line with the substantially cylindrical space 175 being interposed in between.

The compressor 100 according to the present embodiment allows the pressure valve 180 to open and close the pressure bypass 171*d* in accordance with the flow volume Q and the flow velocity v of the coolant gas G flowing through the pressure bypass 171*d*, or the cross-sectional area S and the flow velocity v of the pressure bypass 171*d*. Therefore, without direct detection of the load F on the cross-section of the pressure bypass 171*d* due to the coolant gas G flowing through the pressure bypass 171*d*, it is possible to indirectly calculate the load F by detecting the flow volume Q and the flow velocity v or the cross-sectional area S and the flow velocity v. This can facilitate setting of a predetermined load serving as a threshold value for opening and closing the pressure valve.

It should be noted that in reality the load F can be calculated by only detecting the flow velocity v since the cross-sectional area S is constant.

Fourth Embodiment

The compressor 100 according to the foregoing embodiment is configured to include the pressure bypass 171*d* facing the compressed gas passage 171*b* with the substantially cylindrical space 175 serving as the oil separation space being interposed in between. However, the gas compressor according to the present invention is not limited thereto. The pressure bypass 171*d* can be formed so as to branch from the compressed gas passage 171*b*.

Figure 8A:
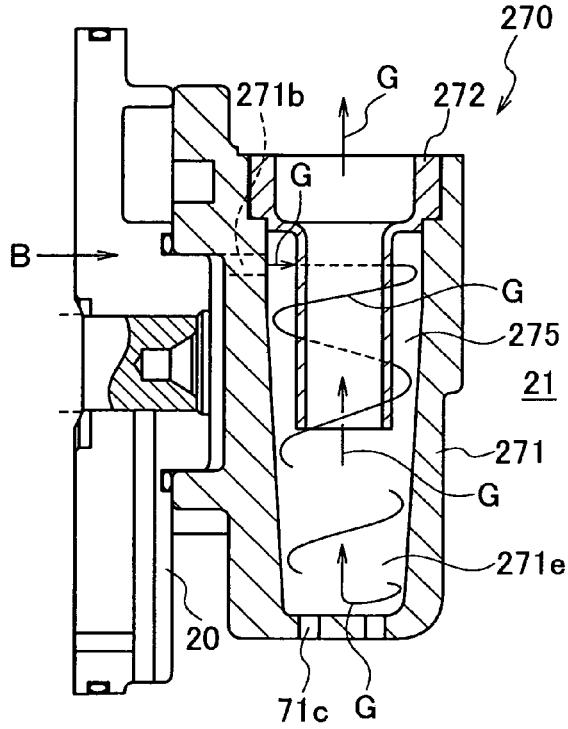
FIG. 8A is a magnified view showing details of a cyclone block in a rotary vane compressor according to a fourth embodiment of the present invention.
Figure 8B:
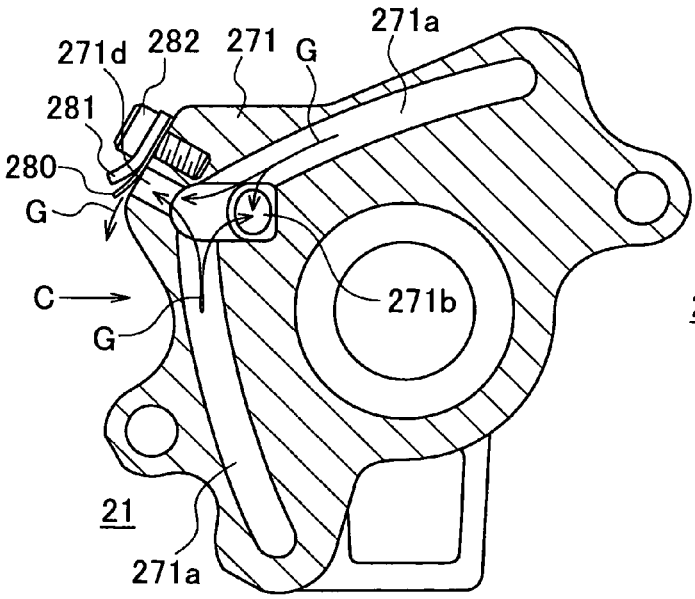
FIG. 8B is a side view of the cyclone block when viewed from a direction indicated by an arrow B in FIG. 8A.
Figure 8C:
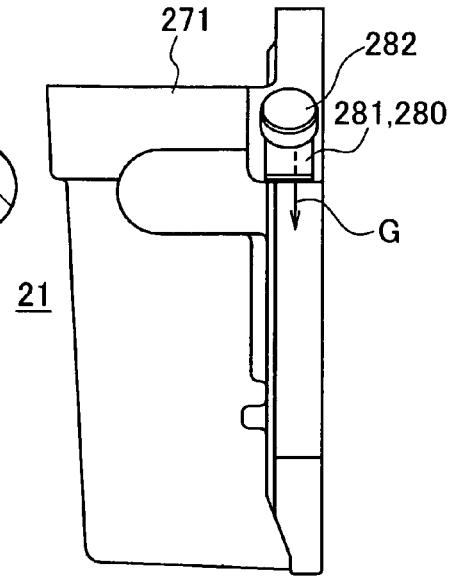
FIG. 8C is a rear view of the cyclone block when viewed from a direction indicated by an arrow C in FIG. 8B.

Specifically, FIGS. 8A to 8C show a cyclone block 270 according to another embodiment of the present invention. The cyclone block 270 in FIG. 8B, for instance, includes a two gas guiding passages 271*a*, 271*a* in a surface thereof which is fitted to the rear side block 20. The two gas guiding passages 271*a*, 271*a* guide, to a single compressed gas passage 271*b*, the compressed coolant gas G discharged from not-shown two discharge chambers (assumed to be formed with a phase difference therebetween by 180 degrees) in the compressor unit 60. A pressure bypass 271*d* extends straight from a portion at which these two gas guiding passage 271*a*, 271*a* meet, to communicate with the discharge chamber 21.

In addition, as shown in FIGS. 8B and 8C, a pressure valve 280 is provided on an outlet side of this pressure bypass 271*d*, which is located at the outer-surface side of an outer cylindrical unit 271.

The compressor 100 including the cyclone block 270 according to the present embodiment can attain the same effects as the compressor according to the foregoing embodiments. Consequently, the compressor 100 according to the present embodiment can prevent the oil content rate (OCR) from being decreased during high speed operation of the compressor unit 60.

As described through the above embodiments, the gas compressor according to the present invention is configured to include a pressure valve in a compressed gas passage or an oil separation space of an oil separator. Through the compressed gas passage, a compressed gas flows from the compressor unit to an oil separator. When the internal pressure in the compressed gas passage or the oil separation space increases due to high-speed rotation of the gas compressor, the gas compressor opens the pressure valve to discharge the compressed gas including unseparated oil to an air conditioning system through a pressure bypass. Thereby, the gas compressor can prevent the oil content rate (OCR) from decreasing excessively.

In the gas compressor according to the present invention, as the pressure of the compressed gas discharged from the compressor unit to the oil separator increases due to high-speed rotation of the compressor unit, the internal pressure increases in the compressed air passage extending from the compressor unit to the oil separator and in the oil separation space of the oil separator to flow the compressed gas therethrough.

With the increases in the internal pressure in the compressed gas passage and the oil separation space of the oil separator, the pressure valve is configured to open the pressure bypass which causes the compressed gas passage or the oil separation space to communicate with the space whose pressure is lower than those of these spaces. As a result, the compressed gas in the compressed gas passage or the oil separation space is flowed into the space having the lower pressure through the pressure bypass before oil is fully separated from the compressed gas in the oil separation space.

Consequently, the compressed gas flowing into the space with the lower pressure includes a larger amount of oil than the compressed gas which is fully centrifuged from the oil in the oil separation space in the conventional manner. Thereby, the compressed gas including a larger amount of oil is discharged from the space with the lower pressure to the outside of each gas compression chamber (or to the air conditioning system), to thereby increase the OCR. Accordingly it is possible to prevent excessive decrease in the OCR during high speed rotation of the compressor unit.

Further, the space having the lower pressure is a space (discharge chamber) to which the compressed coolant gas after separation from refrigeration oil in the oil separation space is discharged. This space is wider than the passage to the discharge chamber from the oil separation space so that the pressure of the compressed gas inside the oil separator (in the oil separation space) is largely differed from that discharged to the outside of the oil separator (to the discharge chamber). For this reason, it is easy to set a threshold of the pressure for opening and closing the pressure valve.

Further, since the pressure valve opens the pressure bypass to decrease the pressure of the oil separation space, it is possible to set required strength of members forming the oil separation space to a lower value than that of members of the conventional gas compressor.

The gas compressor according to the present invention is configured that when the internal pressure of the oil separation space of the oil separator rises excessively, the spring is elastically deformed against its own elastic force due to the internal pressure and separated from the seating surface of the outer cylinder which has been kept in contact with the flange portion of the inner cylinder portion by the spring.

Consequently, the gap between the seating surface and the flange portion functions as the above pressure bypass, and the seating surface, the flange portion and the spring function as the above pressure valve. This allows the compressed gas in the oil separation space to flow through the pressure bypass and the above discharge chamber to be discharged to the outside of the gas compression chambers (or to the air conditioning system).

In contrast, in the conventional gas compressor in which the outer cylindrical unit and the inner cylinder portion are fixed to each other, an excessive increase in the pressure of the compressed coolant gas discharged from the compression chamber due to high-speed rotation of the compressor unit results in increasing the internal pressure of the oil separation space of the oil separator excessively. This makes fixation of the outer cylindrical unit and the inner cylinder portion by caulking or press-fitting unstable to release the fixation.

On the other hand, with a change in rotational speed of the compressor unit from high to low, the internal pressure of the oil separation space of the oil separator is decreased to reduce the amount of elastic deformation of the spring for biasing the flange portion. This allows the flange portion of the inner cylinder portion to return to its original position to be in contact with the seating surface of the outer cylindrical unit. Thereby the pressure bypass is closed, and the oil separator exerts its original oil separation performance.

Unlike in the oil separator of the conventional gas compressor, the high speed rotation of the compressor unit does not affect the fixation between the outer cylindrical unit and the inner cylinder portion in the oil separator of the gas compressor according to the present invention. At the same time, with a change in the rotational speed of the compressor unit from high to low, the oil separator can maintain its original oil separation performance.

Moreover, the gas compressor according to the present invention is configured to include the pressure bypass through which the compressed gas passage to flow compressed gas from the compressor unit to the oil separator or the oil separation space of the oil separator communicates with the space having the lower pressure. In addition, the pressure valve in this pressure bypass opens and closes in accordance with load acting on the cross section of the pressure bypass. Thereby, opening the pressure valve during high speed operation of the gas compressor makes it possible to prevent excessive centrifugation of oil from the compressed gas and accordingly prevent the oil content rate (OCR) from decreasing excessively.

Moreover, the gas compressor thus formed according to the present invention is configured to guide the compressed gas discharged from the compressor unit to the oil separation space of the oil separator and rotate the compressed gas therein. Thereby, the rotation generates a centrifugal force to act on jet stream of the compressed gas, thereby separating the oil from the jet stream.

Here, the oil separation performance increases as the centrifugal force acting on the jet stream increases.

On the other hand, as operation speed of the compressor unit increases, an increased load F acts on the cross section of the pressure bypass into which the jet stream of the compressed gas flows due to the jet stream of the compressed gas discharged from the compressor unit to the oil separator.

The load F[N] is expressed by $$F=\rho Qv$$

where $\rho$[kg/m$^3$], Q[m$^3$/s] and v[m/s] denote the density, the flow volume and the flow velocity of the compressed gas, respectively. Accordingly, an increase in the operation speed of the compressor unit increases the velocity v of the jet stream and the load F.

The increased load F acting on the cross section of this pressure bypass makes the pressure valve in the pressure bypass open to bring the compressed gas passage or the oil separation space into communication with the space whose pressure is lower than those of these spaces. Consequently, the compressed gas in the compressed gas passage or the oil separation space is flowed into the space having the lower pressure via the pressure bypass, before the compressed gas is fully centrifuged in the oil separation space or the oil is excessively separated from the compressed gas.

Compared with the compressed gas which is fully centrifuged in the oil separation space with the pressure valve not open, compressed gas containing a larger amount of oil is flowed into the space having the lower pressure and discharged to the outside of each gas compression chamber (or to the air conditioning system). This resultantly increases the OCR and accordingly prevents excessive decrease in the OCR during high speed rotation of the compressor unit.

Furthermore, in the gas compressor according to the present invention, it is preferable that the pressure bypass is formed to extend straight on an extension line of the compressed gas passage.

In the gas compressor having such preferable configuration, the compressed gas discharged from the compressor unit flows into the oil separator through the compressed gas passage while a part of the compressed gas directly flows through the pressure bypass on the extension line of the compressed gas passage due to inertia of the flowing compressed gas.

The compressed gas flows through the pressure bypass with the force gained flowing through the compressed gas passage maintained. Accordingly, the load acting on the cross section of the pressure bypass precisely reflects the load which acts on the cross section of the compressed gas passage.

As the force of the compressed gas flowing through the compressed gas passage (the load acting on the cross section of the compressed gas passage) increases due to the high speed rotation of the compressor unit, the load acting on the cross section of the pressure bypass increases accordingly. Consequently, it is possible to make the pressure valve open/close in line with the rotational speed of the compressor unit.

Furthermore, the pressure bypass is formed straight, so that attenuation of the load on the pressure bypass from the inlet to the outlet can be decreased to a minimum, compared with a meander pressure bypass. Accordingly, it is possible to prevent the decrease in the precision of the opening/closing operation of the pressure valve when the pressure valve is provided on the outlet side of the pressure bypass.

Moreover, the gas compressor according to the present invention is preferably configured that the compressed gas passage and the pressure bypass face each other with the substantially cylindrical space being interposed in between, and are formed in a straight line.

The gas compressor having such preferable configuration can guide a part of the compressed gas from the compressed gas passage to the substantially cylindrical space and the pressure bypass with the force of the part of the compressed gas maintained.

The gas compressor according to the present invention is preferably configured that the pressure valve open and close the pressure bypass according to the flow volume Q and the flow velocity v of the compressed gas flowing through the pressure bypass or to the cross-sectional area S of the pressure bypass and the flow velocity v.

In the gas compressor with such preferable configuration, the load F acting on the cross section of the pressure bypass can be defined by $$F=\rho Qv$$

where $\rho$[kg/m$^3$], Q[m$^3$/s] and v[m/s] respectively denote the density, the flow volume and the flow velocity of the compressed gas flowing through the pressure bypass. Accordingly, without direct detection of the load F of the compressed gas flowing through the pressure bypass, the load F can be calculated by detecting the flow volume Q and the flow velocity v. This can facilitate setting of a predetermined load as a threshold value for opening and closing the pressure valve.

Similarly, the load F acting on the cross section of the pressure bypass can be defined by $$F=\rho Sv^2$$

where $\rho$[kg/m$^3$], S[m$^2$] and v[m/s] respectively denote the density, the cross-sectional area and the flow velocity of the compressed gas flowing through the pressure bypass. Accordingly, without direct detection of the load F of the compressed gas flowing through the pressure bypass, the load F can be calculated by detecting the cross-sectional area S and the flow velocity v. This can facilitate setting of a predetermined load as a threshold value for opening and closing the pressure valve. Note that in reality the load F can be calculated by only detecting the flow velocity v since the cross-sectional area S is constant.

Furthermore, the gas compressor according to the present invention is configured that the pressure valve is set to open the pressure bypass when the internal pressure is equal to or larger than a predetermined pressure and close the pressure bypass when the internal pressure is lower than the predetermined pressure.

As the rotational speed of the compressor unit of the gas compress increases, the amount of vertical load increases. As the rotational speed thereof decreases, vertical load decreases. The gas compressor according to the present invention is possible to open the pressure valve along with the increase in the rotational speed of the compressor unit and intentionally decrease the amount of oil separated from the compressed gas during high speed rotation of the compressor unit.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A gas compressor comprising:

a compressor unit compressing a supplied gas into a high-pressure compressed gas;

an oil separator separating oil from the compressed gas which is discharged from the compressor unit; and a compressed gas passage through which the compressed gas flows from the compressor unit to the oil separator, wherein:

the oil separator includes an oil separation space into which the compressed gas is introduced to separate the oil therefrom;

a pressure bypass is formed in either of the compressed gas passage and the oil separation space to communicate with a space having a lower pressure than an internal pressure of the oil separation space; and the pressure bypass comprises a pressure valve to open and close the pressure bypass.

2. A gas compressor according to claim 1, wherein the pressure valve opens and closes the pressure bypass in accordance with an internal pressure of either of the compressed gas passage and the oil separation space.

3. A gas compressor according to claim 2, wherein the pressure valve is set to open the pressure bypass when the internal pressure is equal to or more than a predetermined pressure and close the pressure bypass when the internal pressure is lower than the predetermined pressure.

4. A gas compressor according to claim 2, wherein the pressure valve is provided in the oil separation space of the oil separator.

5. A gas compressor according to claim 4, wherein:

the oil separator includes an outer cylindrical unit including a substantially columnar space with one end closed; and an inner cylinder portion in a substantially cylindrical form provided in an axis direction of the substantially columnar space; and a substantially cylindrical space defined by an inner surface of the outer cylindrical unit and an outer surface of the inner cylinder portion is the oil separation space.

6. A gas compressor according to claim 4, wherein:

the oil separator includes an outer cylindrical unit including a substantially columnar space with one end closed, and a seating surface in the other end of the substantially columnar space;

an inner cylindrical unit including an inner cylinder portion in a substantially cylindrical form with a diameter smaller than a diameter of the substantially columnar space, and a flange portion continuing into an end portion of the inner cylinder portion to be able to come in contact with the seating surface; and a spring biasing the inner cylindrical unit to the outer cylindrical unit in an axis direction of the substantially columnar space of the outer cylindrical unit while the inner cylinder portion of the inner cylindrical unit is placed inside the substantially columnar space, so that the flange portion of the inner cylindrical unit comes in contact with the seating surface of the outer cylindrical unit;

a substantially cylindrical space defined by an inner surface of the outer cylindrical unit and an outer surface of the inner cylinder portion of the inner cylindrical unit is the oil separation space; and the spring is set to separate the flange portion of the inner cylindrical unit from the seating surface by the internal pressure of the oil separation space when the internal pressure of the oil separation space is equal to or more than a predetermined pressure, so that the seating surface, the flange portion and the spring function as the pressure valve and a gap between the seating surface and the flange portion functions as the pressure bypass.

7. A gas compressor according to claim 1, wherein the pressure valve opens and closes the pressure bypass in accordance with an amount of vertical load acting on a cross section of the pressure bypass due to the compressed gas flowing through the pressure bypass.

8. A gas compressor according to claim 7, wherein the pressure bypass is formed to extend straight on an extension line of the compressed gas passage.

9. A gas compressor according to claim 8, wherein:

the oil separator includes an outer cylindrical unit including a substantially columnar space with one end closed, and an inner cylinder portion in a substantially cylindrical form in an axis direction of the substantially columnar space;

a substantially cylindrical space defined by an inner surface of the outer cylindrical unit and an outer surface of the inner cylinder portion is the oil separation space; and the compressed gas passage and the pressure bypass face each other with the substantially cylindrical space being interposed in between, and are formed on a straight line.

10. A gas compressor according to claim 7, wherein the pressure valve opens and closes the pressure bypass according to a flow volume and a flow velocity of the compressed gas flowing through the pressure bypass, or to a cross-sectional area of the pressure bypass and the flow velocity.

11. A gas compressor according to claim 7, wherein the pressure valve is set to open the pressure bypass when the amount of vertical load is equal to or larger than a predetermined amount and close the pressure bypass when the amount of vertical load is smaller than the predetermined amount.

* * * * *

UNITED STATES PATENT AND TRADEMARK OFFICE

CERTIFICATE OF CORRECTION

PATENT NO. : 8,092,200 B2
APPLICATION NO. : 12/382792
DATED : January 10, 2012
INVENTOR(S) : Hiroshi Iijima et al.

It is certified that error appears in the above-identified patent and that said Letters Patent is hereby corrected as shown below:

In column 13, line 52 “smaller” should read --larger--.

Signed and Sealed this
Second Day of October, 2012

David J. Kappos

David J. Kappos
*Director of the United States Patent and Trademark Office*